US006298627B1

(12) United States Patent
Richardson

(10) Patent No.: US 6,298,627 B1
(45) Date of Patent: Oct. 9, 2001

(54) BUILDING ELEMENTS

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/338,161

(22) Filed: Jun. 22, 1999

(30) Foreign Application Priority Data

Jun. 19, 1999 (GB) ..... 9914279

(51) Int. Cl.[7] ..... E04B 7/18

(52) U.S. Cl. ..... 52/582.1; 52/588.1; 52/783.1; 52/586.1; 52/583.1

(58) Field of Search ..... 403/337, 336; 52/582.1, 783.1, 583.1, 580, 586.1, 588.1

(56) References Cited

U.S. PATENT DOCUMENTS

| | | | | |
|---|---|---|---|---|
| 4,790,112 | * | 12/1988 | Wang | 52/460 |
| 5,580,620 | * | 12/1996 | Campbell et al. | 428/34 |
| 5,664,826 | * | 9/1997 | Wilkens | 296/181 |
| 5,966,888 | * | 10/1999 | Richardson | 52/580 |
| 6,023,899 | * | 2/2000 | Mecozzi | 52/396.04 |
| 6,164,024 | * | 12/2000 | Konstantin | 52/200 |
| 6,202,382 | * | 3/2001 | Conterno | 52/762 |

FOREIGN PATENT DOCUMENTS

| | | | | |
|---|---|---|---|---|
| 522541A1 | * | 1/1993 | (EP) | E04C/2/54 |
| 624695A2 | * | 11/1994 | (EP) | E04C/2/26 |
| 2207930A | * | 2/1989 | (GB) | E04D/3/36 |
| 2243170A | * | 10/1991 | (GB) | E04B/7/00 |
| 2268765A | * | 1/1993 | (GB) | E04D/3/32 |
| 2318133A | * | 4/1998 | (GB) | E04D/3/32 |

* cited by examiner

*Primary Examiner*—Carl D. Friedman
*Assistant Examiner*—Phi Dieu Tran A
(74) *Attorney, Agent, or Firm*—Rockey, Milnamow & Katz, Ltd.

(57) ABSTRACT

A hollow building element of plastic material for use in forming roof structures comprises one or more longitudinal ducts and having, at opposite sides thereof coupling members, whereby elements may be connected to each other directly or indirectly, wherein lower coupling members at opposite sides of the element are sized to meet with co-operating lower coupling elements of adjacent elements offset from a central axis parallel to adjacent element sides.

4 Claims, 1 Drawing Sheet

BUILDING ELEMENTS

This invention concerns building elements for making structures and structures made from such building elements.

Self-supporting roofs or roof sections are known which comprise a plurality of extruded plastics profile elements connected side-by-side, each element having at least one longitudinal chamber or duct and coupling members, by which neighbouring profile elements are interconnected, the adjacent coupling members of neighbouring profile elements engaging to form a duct.

In our own Patent Application No. GB 2268765A, we propose a hollow building element of plastics material comprising a plurality of hollow ducts in two layers and having, at opposite sides thereof coupling members, whereby elements may be connected to each other, upper coupling members comprising a part engageable with a stiffening or reinforcing beam.

In our subsequent Patent Application No. 2318133A, we propose a hollow building element of plastics material comprising one or more longitudinal ducts and having at opposite sides thereof, coupling members, whereby elements may be connected to each other directly or indirectly, wherein lower coupling members comprise ducted flanges to provide an insulation barrier.

One problem with the use of these building elements is that their lower coupling members generally meet centrally of the space between their end walls, so that when fixing screws are screwed through the coupling members into a supporting beam or the like, the screws can force the coupling members apart. When constructing a roof from such buIlding elements securement of the elements is usually commenced from end of the roof to the other and movement of the building elements apart slightly each time a pair are screwed down can result in the final building element being out of line.

Furthermore, to reduce risk of condensation within the space between adjacent building elements, sealing tape is usually provided between abutting vertical surfaces of lower coupling members. The integrity of the tape can be damaged by the fixing screws and the forcing apart of the building elements as described above separates the sealing tape from one or, other of the elements and break the seal.

An object of this invention is to provide measures to mitigate against the effects of the above-mentioned problem.

According to this invention, a building structure, which may be a roof structure, comprises two or more building members made of plastics material and positionable in side-by-side relation to one another. Each building member comprises one or more longitudinal ducts.

Each building member has a first side and a second side. The first side has a coupling element of a first configuration, which has two spaced, non-ducted walls, and the second side has a coupling element of a second configuration, which has two side walls. A coupling element of the second configuration is adapted to fit between the spaced, non-ducted walls of a coupling element of the first configuration.

The building structure is adapted to receive a fixing screw passing through a fixing screw location, i.e., through the spaced, non-ducted walls of the coupling element of the first configuration and through the confines of the coupling element of the second configuration, between the side walls thereof, in such a manner that the fixing screw does not tend to separate the coupling members having the fixing screw.

Preferably, each coupling element of the first configuration has a first ducted part with two walls, which are spaced by a given distance, and a second part with two non-ducted walls, which are spaced by a greater distance. Preferably, each coupling element of the second configuration comprises a longitudinal duct where said coupling element of the second configuration is adapted to fit between the spaced, non-ducted walls of the second part of a coupling element of the first configuration.

Preferably, each coupling element of the second configuration has two walls, one at each side of the longitudinal duct where said coupling element of the second configuration is adapted to fit between the spaced, non-ducted walls of a coupling element of the first configuration, and the wall at each side thereof is normal to the walls of a coupling element of the first configuration when said coupling element of the second configuration is fitted between the spaced, non-ducted walls of the second part of the coupling element of the first configuration.

The building elements of the invention will usually be made of plastics material, such as polyvinyl chloride or preferably polycarbonate.

This invention will now be further described, by way of example only, with reference to the accompanying drawings, in which.

Figure 1:
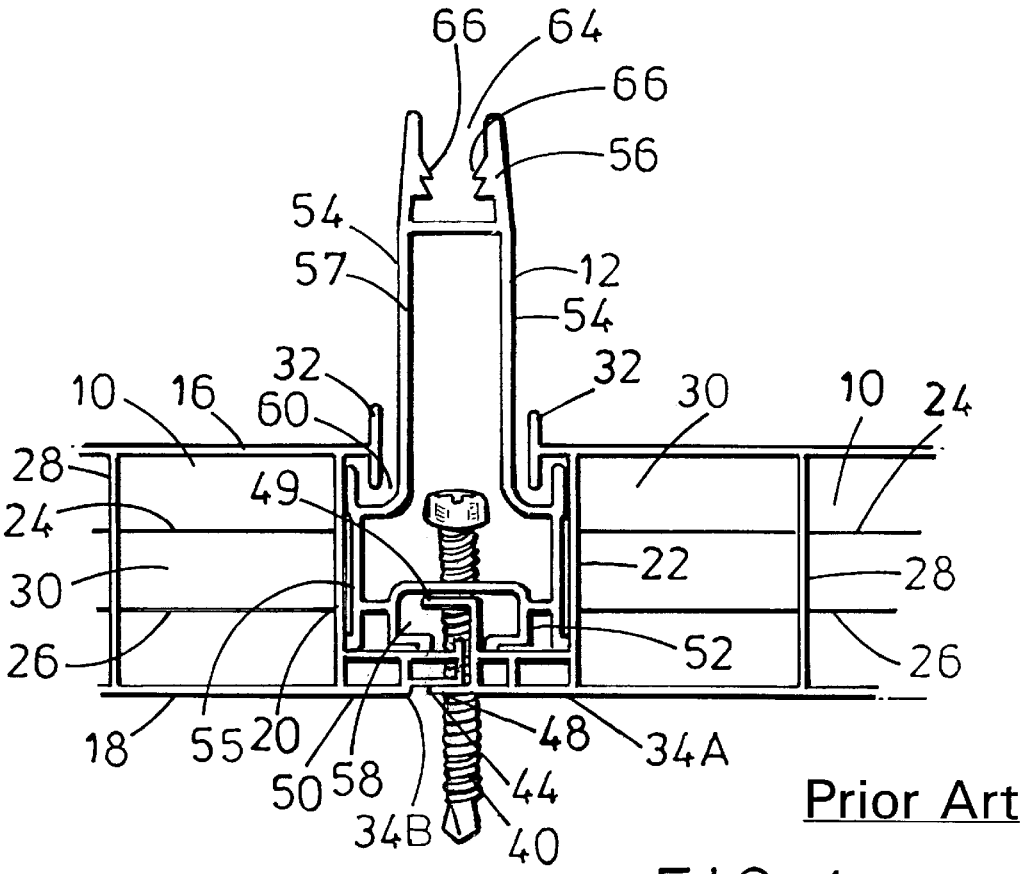
Prior Art FIG. 1
FIG. 1 shows a prior art building structure.

Referring to FIG. 1 of the accompanying drawings, a prior art building structure, such is a conservatory roof, comprises building panels 10 of plastics material, such as polycarbonate, connected together side by side to and by means of aluminium reinforing beams 12. The connection of adjacent panels 10 is sealed by a capping. (not shown) pressed onto the beam 12.

The building panels 10 are hollow and have flat top and bottom walls 16, 18 respectively, end walls 20, 22, intermediate walls 24, 25 parallel to the top and bottom walls and intermediate walls 28 parallel to the end walls, thereby forming ducts 30 through the panels in three rows on top of each other. The intermediate walls 24, 26 and 28 are generally thinner than the outer walls of the panels.

At each end of the panels are upper and lower coupling members 32, 34 respectively. The upper coupling members are the same at each end of the panels, whereas the lower coupling members 34A at one end of the panels are different to the coupling members 34B at the opposite ends of the panels.

The lower coupling member 34A comprises a duct flange extending from the end wall of the panel and terminating with a square C-section part 44 forming a horizontal channel with a bottom wall 48 and a top wall 49, the channel being of greater height than the flange. The lower coupling member 34B comprises ducted flange 50 extending from the opposite end wall of the panel to the coupling member 34A. The flange has its bottom edge stepped upwards at its remote end from the panel to accommodate bottom wall 48 of the coupling member 34A, when two adjacent panels are brought together. Between the abutting vertical faces of the lower coupling members a strip of sealing tape (not shown) is fixed to reduce the risk of condensation formation in the space between the adjacent elements 10.

The reinforcing beam 12 is formed as a hollow extrusion and has a base 52, sides 54 and a top 56. The sides extend upwardly in parallel for a first part 55 before converging towards the top 56 for a second part 57. The base 52 is formed with a channel 58 therealong with rebated sides in order to accommodate top wall 49 of a coupling member 34A.

As can be seen when securing screw 40 is screwed into the coupling members, it penetrates between the ends of the members and can force them apart. If that happens there can be lateral distortion along the roof, so that the final element of the roof can be significantly out of alignment with the supporting end wall for the roof structure. Furthermore, the Integrity of the sealing tape can be damaged and the seal breached by the tape becoming separated from one or other of the building element.

Where the first and second parts of the beam 12 meet, the beam has a pair of upwardly open channels 60. The channels 60 receive upper coupling members 32 of the building elements 10 in the form of downwardly directed projections. The top of the beam is in the form of an open-topped slot 64, with internal notches 66 to retain resilient formations of a capping (not shown).

Figure 2:
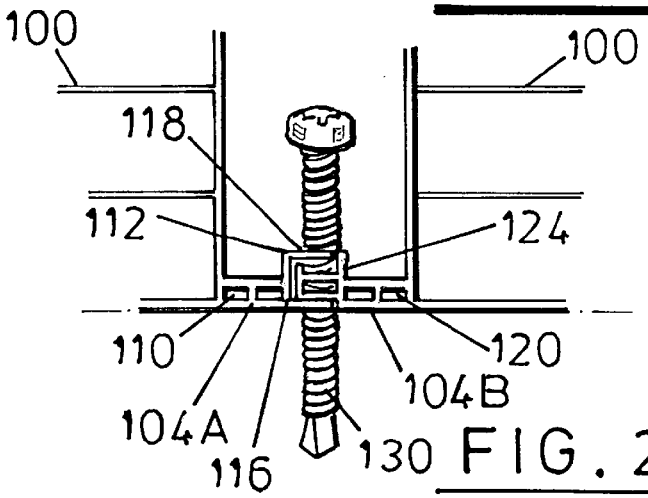
FIG. 2 shows a building structure according to the invention.

Turning to FIG. 2 of the drawings, hollow building panels 100, of the same general type as panel 10 of FIG. 1, are connected together side by side to and by means of a reinforcing beam (not shown) of the same type as 12 in FIG. 1. The connection of adjacent panels 100 is sealed by a capping (not shown) pressed onto the beam. The building panels 100 have upper and lower coupling members at each end. The upper coupling members (not shown) are of the type shown in FIG. 1, whereas lower coupling member 104A at one end of a panel is different to 104B at the other end of the panel.

The lower coupling member 104A comprises a ducted flange 110 extending from the end wall of the panel and terrninating with a square C-section part 112 forming a horizontal channel with a bottom wall 116 and a top wall 118, the channel being of greater height than the flange. The flange has two ducts substantially the same size.

The lower coupling member 104B comprises a ducted flange 120 extending from the opposite end wall of a panel to the coupling member 104A. The flange has three ducts substantially the same width as those of the flange 110. The flange 120 has its bottom edge stepped upwards at its free end to accommodate bottom wall 116 of coupling member 104A when two panels are brought together. The flange 120 also has an upstand 124 which is a continuation of the inner wall of the outermost duct of the flange 120.

The lower coupling member 104B is sized so that its outermost duct lies more or less centrally between the end. walls of the adjacent panels, so that fixing screw 130 can be screwed through that duct rather than between coupling members as happen with the embodiment shown in FIG. 1. Furthermore, the screw 130 also goes through the bottom and top walls 116, 118 of the part 112, so that there is no pushing apart of the panels as the screw is fitted nor damage to sealing tape between abutting vertical faces of the lower coupling members.

To construct a roof using building panels 10 or 100 the panels are laid side-by-side on a structure providing support at opposite ends of the panels with the lower coupling member 34A and B or 104A and B engaged, sealing tape having been affixed between the abutting vertical faces of the lower coupling members. A beam 12 or 101 is then slid into the space between the panels to hold the lower coupling members together and to engage the upper coupling members. Then a screw is secured through the beam and coupling members into an underlying supporting structural component. Finally, a capping is pressed onto the beam until it seats into the panels and is engaged on the heads of the beam.

The lower coupling members being ducted i.e. having an air space therein, provide greater Insulation and inhibit condensation in the regions of contact with the beam.

What is claimed is:

1. A building structure comprising two or more building members made of plastics material and positioned in side-by-side relation to one another, each building member comprising one or more longitudinal ducts, each building member having a first side and a second side, the first side having a coupling element of a first configuration, which has two spaced, non-ducted walls, the second side having a coupling element of a second configuration, which has two side walls, wherein a coupling element of the second configuration is fitted between the spaced, non-ducted walls of a coupling element of the first configuration, and wherein the building structure is adapted to receive a fixing screw passing through the spaced, non-ducted walls of the coupling element of the first configuration and through the confines of the coupling element of the second configuration, and confined between thie side walls of the coupling element of the second configuration, in such a manner that the fixing screw does not tend to separate the coupling elements having the fixing screw.

2. The building structure of clair 1 wherein the side walls of each coupling element of the second configuration define two sides of a longitudinal duct where said coupling element of the second configuration is fitted between the spaced, non-ducted walls of a coupling element of the first configuration.

3. A building structure comprising two or more building members made of plastics material and positioned in side-by-side relation to one another, each building member comprising one or more longitudinal ducts, each building member having a first side and a second side, the first side having a coupling element of a first configuration, which has a first ducted part with two walls spaced by a given distance and a second part with two non-ducted walls spaced by a greater distance, the second side having a coupling element of a second configuration, which has a ducted portion with two side walls, wherein a coupling element of the second configuration is fitted between the spaced, non-ducted walls of a coupling element of the first configuration, such that one of the non-ducted walls of the coupling element of the first configuration defines a screw fixing location, in which a fixing screw can be driven through the spaced, non-ducted walls of the first part of the coupling element of the first configuration and through the ducted portion of the coupling element of the second configuration, and confined between the side walls of the ducted portion, in such a manner that the fixing screw does not tend to separate the coupling elements having the fixing screw.

4. The building structure of claim 1, 2 or 3 wherein the building structure is a roof structure.

* * * * *

UNITED STATES PATENT AND TRADEMARK OFFICE

CERTIFICATE OF CORRECTION

PATENT NO. : 6,298,627 B1
DATED : October 9, 2001
INVENTOR(S) : Christopher Richardson It is certified that error appears in the above-identified patent and that said Letters Patent is hereby corrected as shown below:

Column 2,
Line 34, "25" should be -- 26 --.

Column 3,
Line 28, "terrninating" should be -- terminating --.

Column 4,
Line 5, "Insulation" should be -- insulation --.
Line 24, "thie" should be -- the --.

Signed and Sealed this

Twenty-third Day of April, 2002

*Attest:*

*Attesting Officer*

JAMES E. ROGAN
*Director of the United States Patent and Trademark Office*